US005683296A

United States Patent [19]

Rasmussen

[11] Patent Number: 5,683,296

[45] Date of Patent: Nov. 4, 1997

[54] APPARATUS FOR DETECTING REEL POSITION IN A REEL-TYPE SLOT MACHINE

[75] Inventor: James M. Rasmussen, Chicago, Ill.

[73] Assignee: WMS Gaming Inc., Chicago, Ill.

[21] Appl. No.: 755,138

[22] Filed: Nov. 22, 1996

[51] Int. Cl.[6] ..... G07F 17/34

[52] U.S. Cl. ..... 463/20; 273/143 R

[58] Field of Search ..... 273/143 R; 463/20

[56] References Cited

U.S. PATENT DOCUMENTS 4,618,150 10/1986 Kimura ..... 273/143 R

FOREIGN PATENT DOCUMENTS 3109979 9/1982 Germany ..... 273/143 R 2089088 6/1982 United Kingdom ..... 273/143 R

*Primary Examiner*—Benjamin H. Layno

*Attorney, Agent, or Firm*—Rudnick & Wolfe

[57] ABSTRACT

An apparatus for detecting the position of a reel in a reel-type slot machine is described. A drive gear is mounted on axis with each reel and stepper motor. The drive gear rotates with and is driven by the motor. The drive gear includes at least one flag to detect a home position once every revolution of the reel. The drive gear drives a second gear which has a proportional ratio to that of the drive gear corresponding to the number of symbols displayed on the reel. The driven gear also has one or more flags placed thereon. A detection device positioned near the mesh point of the gears signals both the home position of a reel and intermediate positions corresponding to each display symbol on the reel. Such apparatus can be used to detect the position of the reel with increased accuracy but without adding mass to the reels.

8 Claims, 3 Drawing Sheets

APPARATUS FOR DETECTING REEL POSITION IN A REEL-TYPE SLOT MACHINE

BACKGROUND OF THE INVENTION

This invention relates to gambling machines in general and reel-type slot machines in particular. Such devices typically are enclosed in a housing and are operated by insertion of coins or tokens followed by actuation of a player operated switch in the form of a pull lever or, more recently, push buttons on the from of the machine. When coins have been entered and the switches operated, the system causes the reels to spin and then to stop, displaying a combination of symbols in a view window usually having one or more paylines marked thereon. In modern reel-type slot machines, the control system is typically electronic and includes a micro-processor based control system. In such devices, the micro-processor operates according to its control program to randomly select the symbols to be displayed by the reels. Typically, the processor is programmed to function as a random number generator, picking numbers which correspond to stopping positions on the reels. Thus, the reels themselves form no part of the symbol selection process, but merely display the outcome of play as determined by a random number generator. The selected reel positions are displayed on the payline in the display window.

Reel position is controlled by the processor control system by means of stepper motors, usually one for each reel. These stepper motors, responsive to pulses provided by the control system, rotate and stop the individual reel mechanisms. By counting the pulse signals fed to the stepper motor during revolution of the respective reels, the position of a reel can be monitored by the content of a counter, whereby it is possible to stop the reel at any desired angular position within the 360 degrees of rotation.

It is also known to provide a detection device actuated by one or more light shields or "flags" in the form of projections attached to the spinning reel at fixed circumferential positions. When the reel rotates, the flags pass between an optical position detecting device to designate a home or starting position, and any desired subsequent positions.

The flag may be read as variable "signatures" that equate to specific reel symbols. However, there is the disadvantage that the more sophisticated the light shield profiles become, the larger the light shield needs to be. To achieve and to accommodate this increased size, the light shield needs to be moved further from the center of the reel. The increase in size, mass and radial distance results in more power precision being required to accurately spin and stop the reel. It also increases the cost and complexity of the reel construction.

It is accordingly an object of the present invention to provide an improved position detecting method and apparatus whereby these disadvantages of the prior art are overcome.

It is a further object of the present invention to provide a method and apparatus for providing high resolution sensing of reel position.

Another object of the present invention is to provide a method and apparatus for allowing variable signal detection of specific reel symbols.

Still another object of the invention is to provide a method and apparatus for allowing detection of specific reel stops while greatly reducing the size and structural requirements as well as the power requirements of the motors of the detection apparatus.

Yet another object of the invention is to provide a method and apparatus for detecting non-controlled reel movement such as motion after a play, thereby providing increased security against false payout claims.

SUMMARY OF THE INVENTION

These and other objects of the present invention are accomplished by using a drive gear in association with and mounted on axis with each reel and stepper motor. The drive gear rotates with and is driven by the motor. The drive gear includes at least one flag to detect a home position once every revolution of the reel. The drive gear drives a second gear which has a proportional ratio to that of the drive gear relating to the number of symbols displayed on the reel. This driven gear also has one or more flags placed thereon. A detection device is positioned near the mesh point of the drive gear and the driven gear to detect the position of the flags on both the drive gear and the driven gear. This method of and apparatus for detecting the position of the reel allows increased accuracy without adding mass to the reels.

DETAILED DESCRIPTION OF THE PREFERRED EMBODIMENT

Figure 1:
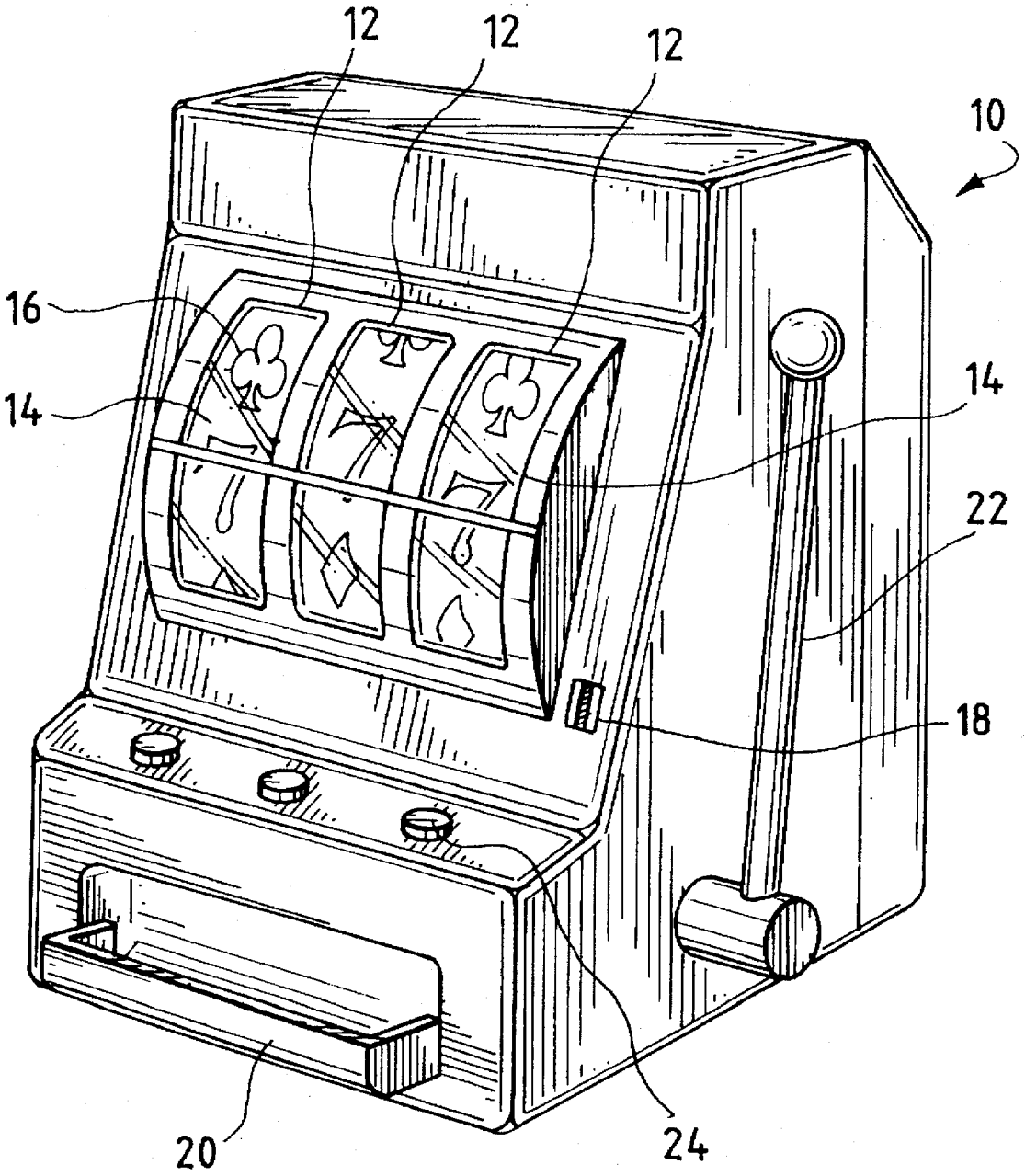
FIG. 1 is a perspective view of a typical slot machine showing elements essential to an understanding of the present invention.

Referring to FIG. 1, there is illustrated a slot machine suitable for use with the present invention. Only the essential features necessary for an understanding of the invention are shown. The slot machine is provided in a cabinet 10 having a viewing window 12 provided therein through which the player may observe symbols 16 on the reels. Typically, there are three reels, each of which has a reel strip 14 on which symbols 16 are printed.

Coins or tokens are placed in slot 18 to activate the game and winning combinations are paid off through a bottom dispensing slot or trough 20. Traditional slot machines include a handle switch 22 for initiating operation of the game, although modem machines also include push button switches such as switch 24 for the same purpose for players who prefer to use it.

Figure 2:
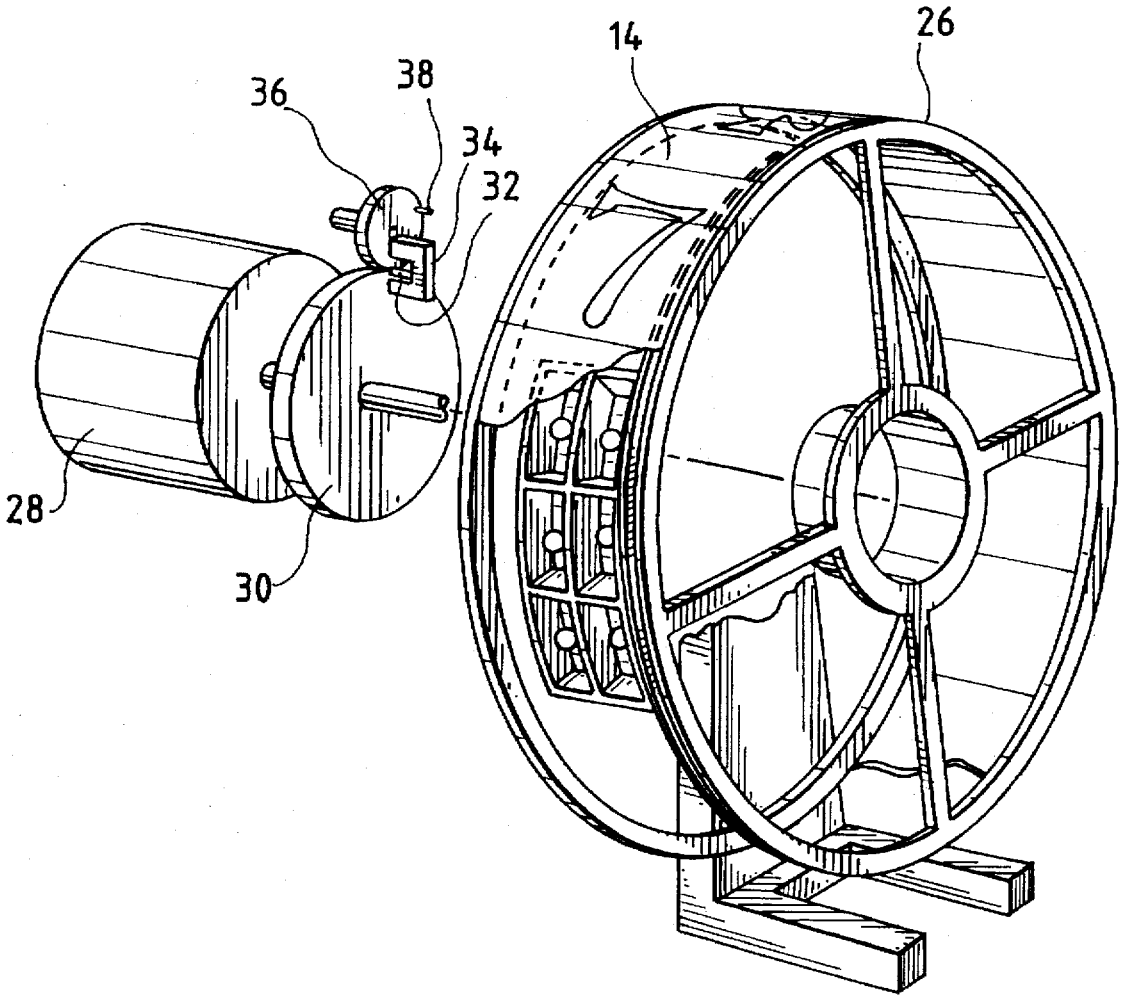
FIG. 2 is a perspective view of a principal portion of a reel mechanism according to the present invention.

Referring to FIG. 2, there is shown an exaggerated perspective view of a typical reel mechanism used in slot machines. The slot machine typically has three reel mechanisms disposed coaxially in side-by-side arrangement. The reel mechanism consists generally of one or more reels 26 on which reel strips 14 are secured for rotation. The reel strip 14 is usually a piece of plastic imprinted with the symbols for the particular game to be played. Rotation of each reel 26 is controlled by a stepper motor 28 connected to the reel for that purpose. The stepper motors are operated by the appropriate driver circuitry under the control of the game microprocessor system.

According to the invention, a drive gear 30 is mounted coaxially with each reel. The drive gear 30 rotates with the motor and the reel. There is on each drive gear one light shield in the form of a flag 32 projecting therefrom for detecting the home or zero position of the reel 26. Upon rotation of the drive gear, the flag 32 passes through an optical sensor 34 disposed at a fixed position, thereby providing a home or zero position from which the amount of angular movement of the reel is measured. Upon detection of the flag 32 by the optical sensor 34, the stop count for a reel is reset to zero.

For detecting specific reel positions, a second gear 36 is provided and driven by gear 30. There is on each driven gear 36 one or more fight shields 38 typically in the form of a flag projecting in the horizontal direction. Upon rotation of the driven gear 36, the flag 38 passes through the optical sensor 34 positioned near the mesh point of drive gear 30 and driven gear 36. Gears 30 and 36 are used by way of example. Any method of motion multiplication may be utilized to achieve this same outcome.

In a preferred embodiment of the present invention, the driven gear 36 has a ratio that is proportional to that of the drive gear 30 in relation to the number of symbols displayed on the reel. Accordingly, if the reel has n symbols, the driven gear is selected so that it rotates n times per reel revolution, providing n signals per revolution. As the number of driven gear flags is increased, the number of signals produced in a reel revolution is multiplied by the number of driven gear flags.

As an example, if the reel has ten (10) symbols per revolution, the driven gear can rotate ten (10) times for each single reel revolution. One flag on the driven gear will provide 10 signals for each reel revolution. As the number of driven gear flags is multiplied, the number of signals produced during a reel revolution is multiplied by the number of driven gear flags. These additional flag positions can be used to increase signaling frequency allowing more precise control of reel position.

The reel strip 14 may be changed for various reasons, and when this occurs, different gear ratios can be used for gear 36 to adapt to the various signal frequencies required. By way of example, gear ratios of 11:1, 9:1 and 8:1 can be created by changing the drive gear and/or driven gear.

Likewise, by varying the width of one or more of the flags 38, it is possible to provide variable signal patterns corresponding to specific reel positions.

Figure 3:
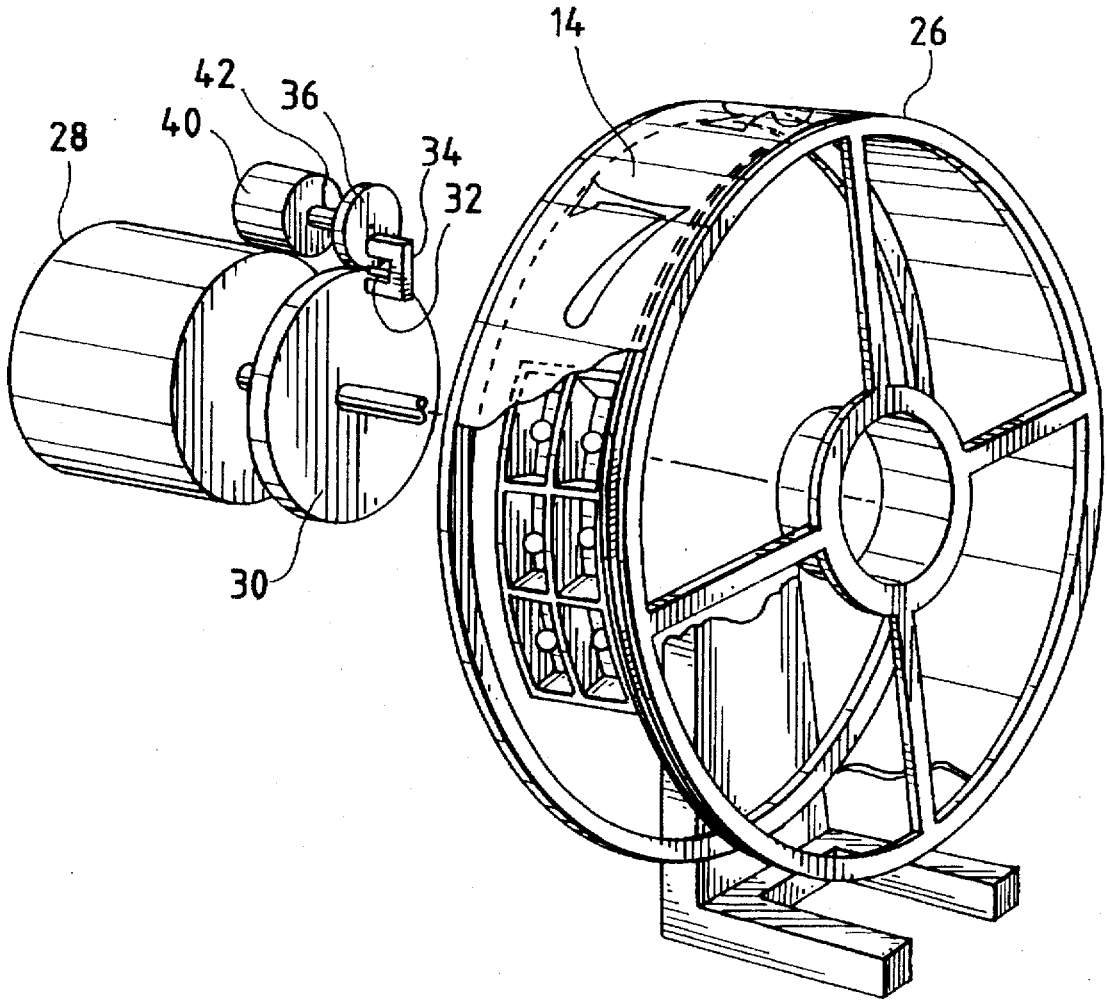
FIG. 3 is a perspective view of an alternative embodiment of the present invention wherein an encoder disc is substituted for the driven gear flag.

Referring to FIG. 3, a second embodiment of the invention is shown wherein an optical shaft encoder 40 is secured to driven gear shaft 42. Instead of flags on the driven gear, a commercially available shaft encoder is used to generate signals corresponding to each motor step and/or display symbol. Thus, the drive gear flag 32 generates the home signal. The display symbols are signaled by the shaft encoder 40 permitting the reel to be stopped at any desired symbol or space on the reel strip. By configuring the encoder disc to rotate with the driven gear, the effective resolution of an encoder disc can be increased by a factor of N with no increase in disc size. This embodiment also eliminates the need to change gear ratios between the drive and driven gear for different numbers of symbols. It also eliminates the need to change the number of flags on the driven gear. To accommodate a different number of symbols, the game control computer simply responds to a different set of shaft encoder signals.

The shaft encoder can also function to differentiate between clockwise and counterclockwise rotation of the reel to monitor changes in reel direction and to determine the direction of the reel rotation.

The benefits of either embodiment are that reel detection and signaling are achieved without adding mass to the reels. By removing the mass of the detection device from the spinning reel member, both the structural requirements of the reel and the power requirements of the stepper motors are minimized, allowing smaller, lower power, and/or less expensive motors to be used. There is the further benefit that, as games become more animated in their motion requirements in response to various game themes, additional motor power is available for such motion requirements. Still another benefit is that variable signal patterns permit high resolution detection of reel positions to be achieved, while reducing the spinning mass. Such increased signaling frequency can also be used to detect motion after a play, read as non-controlled reel movement and registered as a tilt.

While we have shown and described illustrative embodiments and uses of the present invention, it will be understood by those of ordinary skill in the art that changes and modifications may be made to the illustrative embodiments without departing from the invention in its broader aspects. Various features of the present invention are set forth in the following claims.

What is claimed is:

1. An apparatus for detecting the position of a reel in a reel-type slot machine comprising:

(a) at least one reel mounted for rotation having a plurality of display symbols thereon;

(b) drive means for rotating and stopping said reel(s) at specified symbol positions;

(c) a drive gear mounted on axis with each reel having a light shield mounted thereon to signal a home position once every complete revolution of said reel;

(d) a driven gear having at least one light shield mounted thereon, said driven gear meshed with said drive gear;

(e) detector means positioned proximate the mesh point of said drive and driven gears for generating signals when said light shields are detected;

(f) said driven gear having a gear ratio, relative to said drive gear, such that the light shield(s) thereon generate a signal corresponding to each display symbol on said reel;

whereby said detector means signals both the home position of a reel and intermediate positions corresponding to each display symbol on said reel.

2. An apparatus as recited in claim 1 wherein said driven gear has one flag thereon and its gear ratio is selected to cause it to rotate one complete revolution for each symbol on said reel.

3. An apparatus as recited in claim 1 wherein said driven gear has two flags thereon and its gear ratio is selected to cause it to rotate one haft revolution for each symbol on said reel.

4. An apparatus as recited in claim 1 wherein said drive means is a stepper motor.

5. An apparatus as recited in claim 1 wherein said detector means is an optical detector.

6. An apparatus for detecting the position of a reel in a reel-type slot machine comprising:

(a) at least one reel mounted for rotation having a plurality of display symbols thereon;

(b) drive means for rotating and stopping said reel(s) at specified positions;

(c) a drive gear mounted on axis with each reel having a light shield mounted thereon to signal a home position once every complete revolution of said reel;

(d) a driven gear mounted to a shaft for rotation, said driven gear meshed with said drive gear;

(e) detector means positioned proximate the mesh point of said drive and driven gears for generating signals when said light shield is detected;

(f) an optical shaft encoder coupled to said driven gear shaft for generating signals corresponding to each display symbol on said reel;

whereby said detector means signals the home position of a reel and said encoder signals intermediate positions corresponding to each display symbol on said reel.

7. An apparatus as recited in claim 6 wherein said drive means is a stepper motor.

8. An apparatus as recited in claim 6 wherein said detector means is an optical detector.

* * * * *